United States Patent [19]

Dessau et al.

[11] Patent Number: 5,037,529

[45] Date of Patent: Aug. 6, 1991

[54] INTEGRATED LOW PRESSURE AROMATIZATION PROCESS

[75] Inventors: Ralph M. Dessau, Edison; Randall D. Partridge, W. Trenton, both of N.J.; Sharon B. McCullen, Newtown, Pa.; Nai Y. Chen, Titusville, N.J.

[73] Assignee: Mobil Oil Corp., Fairfax, Va.

[21] Appl. No.: 459,403

[22] Filed: Dec. 29, 1989

[51] Int. Cl.[5] ..... C10G 35/04

[52] U.S. Cl. ..... 208/64; 208/133; 585/407

[58] Field of Search ..... 208/64, 133; 585/407

[56] References Cited

U.S. PATENT DOCUMENTS

| | | | |
|---|---|---|---|
| Re. 29,948 | 3/1979 | Dwyer et al. | 208/110 |
| 3,702,293 | 11/1972 | Hayes et al. | 208/139 |
| 3,702,294 | 11/1972 | Rausch | 208/139 |
| 3,878,131 | 4/1975 | Hayes | 252/466 PT |
| 4,104,320 | 8/1978 | Bernard et al. | 260/673.5 |
| 4,325,808 | 4/1982 | Kim | 208/65 |
| 4,347,394 | 8/1982 | Detz et al. | 585/419 |
| 4,387,258 | 6/1983 | Vadekar et al. | 585/259 |
| 4,416,806 | 11/1983 | Bernard et al. | 502/74 |
| 4,418,006 | 11/1983 | Kim et al. | 502/73 |
| 4,435,283 | 3/1984 | Buss et al. | 208/138 |
| 4,443,326 | 4/1984 | Field | 208/64 |
| 4,456,527 | 6/1984 | Buss et al. | 208/89 |
| 4,486,547 | 12/1984 | Imai et al. | 502/223 |
| 4,487,843 | 12/1984 | Telford et al. | 502/85 |
| 4,487,848 | 12/1984 | Robinson et al. | 502/223 |
| 4,547,472 | 10/1985 | Nordstrand | 502/66 |
| 4,576,805 | 3/1986 | Chang et al. | 423/277 |
| 4,588,495 | 5/1986 | Franck et al. | 208/65 |
| 4,604,371 | 8/1986 | Moorehead | 502/60 |
| 4,614,834 | 9/1986 | Lambert et al. | 585/419 |
| 4,619,906 | 10/1986 | Lambert et al. | 502/66 |
| 4,882,040 | 11/1989 | Dessau et al. | 208/138 |
| 4,935,566 | 6/1990 | Dessau et al. | 208/65 |
| 4,936,976 | 6/1990 | Harandi et al. | 585/407 |

FOREIGN PATENT DOCUMENTS

| | | |
|---|---|---|
| 0107389 | 4/1984 | European Pat. Off. . |
| 2033358 | 5/1980 | United Kingdom . |
| 2114150 | 8/1983 | United Kingdom . |

OTHER PUBLICATIONS

G. Wengui et al, "IR Study of Framework Vibrations and Surface Properties of High Silica Zeolites", Zeolites, Elsevir Science, Amsterdam, 1985, p. 279.

Ione, Journal of Molecular Catalysis, 31, pp. 355–370 (1985).

Ione, "Structure and Reactivity of Modified Zeolites", Elsevir Science (1984), pp. 151–155.

Huagong, vol. 15, No. 7 (1986) (with translation), pp. 405–410.

*Primary Examiner*—Curtis R. Davis

*Attorney, Agent, or Firm*—Alexander J. McKillop; Charles J. Speciale; Marina V. Schneller

[57] ABSTRACT

High purity benzene and high octane alkylaromatic gasoline can be obtained via a dual stage reforming process utilizing a non-acidic Group VIII metal containing microporous crystalline silicate catalyst in the first stage followed by first stage effluent treatment over acidic zeolite catalyst operating under conditions in the second stage to upgrade the first stage effluent in RON, in aromatic content or both.

15 Claims, No Drawings

INTEGRATED LOW PRESSURE AROMATIZATION PROCESS

FIELD OF THE INVENTION

Enhanced yields of aromatics from $C_6$–$C_{12}$ paraffin-containing feeds can be obtained via a dual stage and dual catalyst reforming process. In the first stage the catalyst is a "non-acidic" Group VIII metal-containing platinum/indium, platinum/thallium or platinum/tin in a non-acidic microporous, crystalline silicate exhibiting the X-ray diffraction pattern of a zeolite.

In the second stage, the catalyst is an acidic zeolite catalyst which can optionally contain a dehydrogenation promoter such as zinc or gallium. The conditions of the second stage, discussed below, may be determined by the nature of the feed and/or the nature of the product desired.

BACKGROUND OF THE INVENTION

Very large amounts of benzene and toluene are consumed annually. These materials find use as chemical intermediates, solvents, and in gasoline.

By far the largest proportion of the available benzene and toluene is made in petroleum refining by the so-called (petroleum naphtha) reforming process. This process is so well known that it need not be described in detail here. Briefly, one of the major reactions in catalytic reforming is the isomerization and dehydrogenation of five and six-membered naphthene compounds contained in the naphtha to form a mixture of benzene, toluene, and xylene which materials can be recovered by distillation and solvent extraction as a mixture commonly referred to as "BTX". This mixture can be resolved by distillation to provide merchant benzene, toluene, and mixed xylenes for further use.

The statutory elimination of lead from most gasolines has compelled refiners to rely heavily on hydrocarbon conversion processes that produce gasoline blending stocks having a high octane number even without the inclusion of lead. Two principal processes for accomplishing this are alkylation and reforming, which produce such high octane blending stocks for the lead-free gasolines. Accordingly, refiners who rely heavily on reforming for gasoline production are understandably reluctant to allow the reformate product to be stripped of the high octane aromatics. There results from this situation a decrease in the available supply of benzene and toluene and a concomitant increase in their cost. There is an evident growing need for alternative methods to manufacture benzene and toluene, methods which do not rely on reformate as the principal source.

Catalytic reforming is a process in which hydrocarbon molecules are rearranged, or reformed in the presence of a catalyst. The molecule rearrangement results in an increase in the octane rating of the feedstock. Thus, during reforming low octane hydrocarbons in the gasoline boiling range are converted into high octane components by dehydrogenation of naphthenes and isomerization, dehydrocyclization and hydrocracking of paraffins.

By way of illustration, the significance of those reactions in reforming can be gleaned from a review of the following table from "Catalysis," vol VI, P. H. Emmett (ed). Copyright 1958 by Litton Educational Publishing Company:

| Octane Numbers of Pure Hydrocarbons | |
|---|---|
| Hydrocarbon | Blending research octane number (clear) |
| Paraffins: | |
| n-Butane | 113 |
| N-Pentane | 62 |
| n-Hexane | 19 |
| n-Heptane | 0 |
| n-Octane | −19 |
| 2-Methylhexane | 41 |
| 2,2-Dimethylpentane | 89 |
| 2,2,3-Trimethylbutane | 113 |
| Naphthenes (cycloparaffins): | |
| Methylcyclopentane | 107 |
| 1.1-Dimethylcyclopentane | 96 |
| Cyclohexane | 110 |
| Methylcyclohexane | 104 |
| Ethylcyclohexane | 43 |
| Aromatics: | |
| Benzene | 99 |
| Toluene | 124 |
| 1,3-Dimethylbenzene | 145 |
| Isopropylbenzene | 132 |
| 1,3,5-Trimethylbenzene | 171 |

Naphtha reforming may also be utilized for the production of benzene, toluene, ethylbenzene, and xylene aromatics. A valuable by-product of naphtha reforming is hydrogen, which may be utilized for hydrotreating and upgrading of other hydrocarbon fractions. Generally, the molecular rearrangement of molecular components of a feed, which occurs during reforming, results in only slight, if any, changes in the boiling point of the reformate (the product of reforming), compared to that of the feed. Accordingly, reforming differs from both cracking and alkylation, both refinery processes, each of which does result in changes of boiling range of the product compared to the feed. That is, in cracking, large molecules are cracked into smaller ones; whereas, in alkylation small molecules are rebuilt into larger molecules.

The most important uses of the reforming process are briefly mentioned: the primary use of catalytic reforming may be concisely stated to be an octane upgrader and a route to premium gasoline. Catalytic reforming is the only refining process that is capable of economically making a gasoline component having high clear research octane ratings. The charge to the reformer (straigh-run, thermal, or hydrocracker naphtha) is usually available in large quantities and is of such low quality that most of it would be unsaleable without reforming.

A correlative use of catalytic reforming is in its ability to produce gasolines of acceptable volatility over a wide range of yields, through proper selection of feedstock and/or operating conditions. The refiner is thus able to vary the yield of gasoline very substantially to meet demand fluctuations. For European demand patterns, where gasoline sales are limiting and it is desired to produce as much middle distillate as practicable, the reformer can be operated on a lighter, lower volume of naphtha to minimize gasoline production while maintaining high crude runs.

Hydrogen, although often considered a by-product, is still a valuable output from the reformer. Normally, it is produced in amounts ranging from 300 to 1200 SCF/Bbl, depending on the type of feed stock and reformer operating conditions. Reformer hydrogen is used to remove unwanted contaminants from reformer feed stocks, for hydrodesulfurization of distillates, hydrocracking of heavy fractions, hydrotreating of lubes and various chemical operations. Hydrogen availability and utilization is expected to assume increasing importance as pollution restrictions lead to increasing hydroprocessing in future years.

The importance of reforming is reflected by data which indicates that finished pool gasoline is about 35% reformate in complex refineries, but can run as high as 80% in topping-reforming refineries. As lead is phased out of gasoline, more and more straight run stocks which are now blended directly into gasoline will be reformed. All current commercial reformers use a platinum containing catalyst with a hydrogen recycle stream. Within this broad definition, there are a great number of different process designs. More than 75% of the industry's reforming capacity is classified as semi-regenerative. A semi-regenerative reformer is one which runs until the catalyst is coked and then is shut down and regenerated. The time period between regenerations varies from several months to as long as 1½ years.

Within the category of semi-regenerative reforming, a further breakdown can be made on the basis of operating pressure. Units with separator pressures of 450 psig or higher are considered high pressure units. Those with pressures of 300 psig or less are called low pressure units. Anything in between is intermediate pressure. Most of the older units are high pressure, while the newer designs are low or intermediate pressure. Lower pressures give better reformate yields at a given octane level.

Another type of reformer is the cyclic variety. A cyclic unit has the reactors manifolded in such a way that any reactor can be taken out of reforming service and regenerated while the other reactors are still reforming. The time period between regenerations for a cyclic reactor varies from 2 to 10 days. All cyclics are low pressure.

A third type of reformer that has recently been commercialized is the continuous unit. In this type of reformer, catalyst is withdrawn from the unit during reforming, regenerated in small batches in separate regeneration facilities and then replaced in the unit. The regeneration period for continuous units is about one month. As in the case for cyclic units, all continuous units are low pressure.

The reformer is run to operate at a given octane for the reformate, under adiabatic conditions. Thus, the unit can be run at low octane severity or at high octane severity. By way of explanation, it is noted that in the semi-regenerative process comprising several manifolded units the reformate from the last of the units will be characterized by the desired octane, while that product of the preceding manifolded units will be of successively lower octane. Because of both thermodynamics and kinetics of reforming, cracking, if it occurs, predominates at the end of the reforming operation particularly in the semi-regenerative process (i.e. in the last of three units) and in the continuous process. Cracking of long chain paraffins of low octane value (which decrease the final octane of the reformate) results in decreased liquid yields. The cracking of such paraffins results in products outside the boiling range of the reformate. It also results in deactivation of the catalyst, e.g. by coking and deposit of carbonaceous matter other than coke on the catalyst, in a way that is not attributable to the other reactions occurring during reforming. In the semi regenerative and continuous reforming processes, cracking would predominate in the last unit.

Prior to about 1950 chromium oxide or molybdenum oxide supported on alumina were used to effect the two functions of a reforming catalyst. The hydrogenation-dehydrogenation function for paraffin olefin conversion during reforming is effected by the metals chromium and molybdenum and more recently platinum, rhenium, admixtures thereof and noble-metal containing trimetallic alloys. Isomerization activity was provided by acidified alumina.

From the commercialization of platinum reforming in the middle 1950's to the late 1960's, there were no significant improvements in reforming catalysts.

In the late 1960's dramatic breakthrough in reforming catalysts occurred. This was the introduction of the platinum-rhenium bimetallic catalysts. These catalysts have greatly improved stability compared to platinum-only catalysts. By way of background, the platinum and platinum bimetallic catalysts were generally supported on carriers.

Recently, the patent literature has started to recognize the use of platinum and zeolite containing catalyst compositions in reforming. That is, the zeolite may replace in whole or in part the function of alumina in prior reforming catalysts. U.S. Pat. No. 4,456,527 and U.S. Pat. No. 4,443,326 describe zeolite L as a component in a composition for catalyzing reforming.

Zeolites include naturally occurring and synthetic zeolites. They exhibit catalytic properties for various types of hydrocarbon conversions. Zeolites are porous crystalline aluminosilicates having definite crystalline structure as determined by X-ray diffraction studies. Such zeolites have pores of uniform size which are uniquely determined by unit structure of the crystal. The zeolites are referred to as "molecular sieves" because interconnecting channel systems created by pores of uniform pore size allow a zeolite to selectively absorb molecules of certain dimensions and shapes.

By way of background, one authority has described the zeolites structurally, as "framework" aluminosilicates which are based on an infinitely extending three-dimensional network of $AlO_4$ and $SiO_4$ tetrahedra linked to each other by sharing all of the oxygen atoms. Furthermore, the same authority indicates that zeolites may be represented by the empirical formula $$M_{2/n}O.Al_2O_3.xSiO_2.yH_2O$$

In the empirical formula, x is equal to or greater than 2, since $AlO_4$ tetrahedra are joined only to $SiO_4$ tetrahedra, and n is the valence of the cation designated m. D. Breck, ZEOLITE MOLECULAR SIEVES, John Wiley & Sons, New York p. 5 (1974). In the empirical formula, the ratio of the total of silicon and aluminum atoms to oxygen atoms is 1:2. M was described therein to be sodium, potassium, magnesium, calcium, strontium and/or barium, which complete the electrovalence makeup of the empirical formula.

The prior art describes a variety of synthetic zeolites. These zeolites have come to be designated by letter or other convenient symbols, as illustrated by the zeolite. The silicon/aluminum atomic ratio of a given zeolite is often variable. Moreover, in some zeolites, the upper limit of the silicon/aluminum atomic ratio is unbounded. ZSM-5 is one such example wherein the silicon/aluminum atomic ratio is at least 2.5 and up to infinity. U.S. Pat. No. 3,941,871, reissued as U.S. Pat.

No. 29,948, discloses a porous crystalline silicate made from a reaction mixture containing no deliberately added aluminum and exhibiting the X-ray diffraction pattern characteristic of ZSM-5. Various patents describe inclusion of elements other than silicon and aluminum in the preparation of zeolites. Cf. U.S. Pat. No. 3,530,064, U.S. Pat. Nos. 4,208,305 and 4,238,318 describe the preparation of silicates in the presence of iron.

Zeolites may be classified by pore size. ZSM-5 is a member of a class of zeolites sometimes referred to as medium pore zeolites. The pore sizes of medium pore zeolites range from about 5 to about 7 Angstroms.

Another class of zeolites sometimes referred to as large pore zeolites include inter alia naturally occurring faujasite, synthetic zeolites X,L,Y and zeolite beta. These zeolites are characterized by pore sizes greater than those of the medium pore zeolites. The pore sizes of large pore zeolites are greater than about 7 Angstroms. Because of the larger pore sizes these latter zeolites may be less (molecule) shape selective.

SUMMARY OF THE INVENTION

The invention provides a process for manufacturing benzene, toluene, or mixtures thereof which comprises reacting under dehydrocyclization conditions a feed comprising normal paraffins such as normal hexane or normal heptane or a mixture thereof, with a non-acidic dehydrocyclization catalyst comprising a platinum group metal, a crystalline microporous silicate exhibiting the X-ray diffraction pattern of a zeolite and a modifier selected from the group consisting of tin, thallium, and indium.

In accordance with the invention, naphthas rich in $C_6$ and $C_7$ paraffins, difficult to reform selectively using conventional catalysts, are reformed, in a first stage, over compositions containing a reforming metal and crystalline microporous non-acidic materials containing said modifiers. The reformate produced thereby is characterized by higher net yield of aromatic gasoline than would result from reforming in the presence of conventional reforming catalysts.

In accordance with the invention, the second stage of the process includes cyclization, aromatization, cracking, oligomerization and/or alkylation of the components of the effluent of the first stage over an acidic zeolitie containing catalyst composition. The zeolite in the second stage is one exhibiting a Constraint Index of 1 to 12. Optionally, the catalyst composition of the second stage contains a dehydrogenation component such as gallium and/or zinc. The conditions of the second stage can range from about atmospheric pressure to about 500 psig, 400° to 1200° F., a liquid hourly space velocity of 0.1 to 10 and a hydrogen cofeed:hydrocarbon feed of 0 to 10:1.

DETAILED DESCRIPTION OF THE INVENTION

Feedstocks to First Stage

The feedstock charge to the new reforming process can be straight-run, thermal, or catalytically cracked naphtha. Typically, naphthas boil at 80° to 400° F. Preferably, for high increases in the aromatic content and high octane numbers of the reformate, the charge to the reformer is a naphtha rich in $C_6$ to $C_{10}$ paraffins; these are generally difficult to reform selectively using conventional catalysts (such as chlorided Pt-alumina). $C_3$+ feeds can be charged to the first stage for dehydrogenation. $C_6$ and $C_6$+ feeds are generally converted by dehydrocyclization.

Naphtha fractions boiling below 150° F., which contain pentanes and methylpentanes, are preferably taken as gasoline by blending or processed separately. The higher boiling fractions, for example, 150°-400° F. which contain n-$C_6$+ paraffins are processed at reforming conditions over the catalyst used in the first stage of this invention. In another embodiment, this naphtha is separated into fractions, at least one of which is processed.

For example, the 180°-250° F. light naphtha fraction containing n$C_6$-$C_7$ paraffins is processed over the first stage catalyst. This light naphtha fraction is difficult to convert selectively to aromatics over traditional dual functional reforming catalysts, where paraffin isomerization and hydrocracking reactions compete. The remaining 250° F. fraction can be processed over conventional reforming catalyst.

The naphtha fractions may be hydrotreated prior to reforming; but hydrotreating is not necessarily required when using the first stage catalyst in accordance with the invention. Initial hydrotreating of a hydrocarbon feed serves to convert sulfur, nitrogen and oxygen derivatives of hydrocarbon to hydrogen sulfide, ammonia, and water while depositing metal contaminant from hydrodecomposition of any organo-metal compounds. Where desired, interstage processing of the effluent from the hydrotreating zone may be effected. Such interstage processing may be undertaken, for example, to provide additional hydrogen, to add or remove heat or to withdraw a portion of the hydrotreated stream for treatment which need not be reformed. Hydrotreating of the heavy naphtha fraction may be essential, prior to reforming in a conventional reforming process. Suitably, the temperature in the hydrotreating catalyst bed will be within the approximate range of 550° F. to 850° F. The feed is conducted through the bed at an overall space velocity between about 0.1 and about 10 and preferably between about 0.2 and about 2, with hydrogen initially present in the hydrotreating zone in an amount between about 1000 and 10,000 standard cubic feet per barrel of feed, corresponding to a ratio of between about 2.4 and about 24 moles of hydrogen per mole of hydrocarbon. The catalyst may be any of the known hydrotreating catalysts, many of which are available as staple articles of commerce. These hydrotreating catalysts are generally metals or metal oxides of Group VIA and/or Group VIII deposited on a solid porous support, such as silica and/or metal oxides such as alumina, titania, zirconia or mixtures thereof. Representative Group VIA metals include molybdenum, chromium and tungsten and Group VIII metals include nickel, cobalt, palladium and platinum. These metal components are deposited, in the form of metals or metal oxides, on the indicated supports in amounts generally between about 0.1 and about 20 weight percent.

First Stage Conditions

When reforming is undertaken in the first stage in accordance with the invention, the temperature of reforming in accordance with the invention can range from 800° F. to 1100° F., generally being greater than about 900° F., preferably 900° F. (482° C.) to 1050° F.; the pressure will be from about 1 atmosphere to 500 psig, preferably from 30 psig to 250 psig; inlet $H_2$/hydrocarbon can be 10 or less, even zero (0) (because of hydrogen production during reforming, there will be a hydrogen partial pressure in the unit); while the LHSV (liquid hourly space velocity) can be 0.1 to 20, preferably 0.1 to 10.

Preferably the hydrogen partial pressure in the first stage of the reforming process of the invention is reduced by adding a stream of a non-hydrogen diluent, as a cofeed, inert in that it (the diluent) does not react directly to form aromatics, in the first stage of the process although that diluent can form aromatics under the conditions of the process in the second stage.

The diluents can be helium, nitrogen, carbon dioxide, and light hydrocarbons through $C_5$ such as methane, ethane, propane, butane, pentane, ethylene, propylene, butenes, pentenes and mixtures thereof. The use of $C_3$–$C_5$ hydrocarbons as cofeeds may be particularly desirable in that they can be easily separated from the hydrogen produced in the aromatization reactions. The diluent may also be recycle of part or all of the aromatic rich reformate. Accordingly, the diluents can constitute aromatic compounds.

The diluent to hydrocarbon feed molar ratio can range from 1 to about 20 with best results obtained in the range of about 2:1 to 10:1.

First Stage Catalyst

The catalyst in the first stage is a two component catalyst comprising a hydrogenation/dehydrogenation component and non-acidic crystalline microporous material containing a modifier which is tin, indium or thallium. The hydrogenation/dehydrogenation component can be those including a platinum group metal; platinum-rhenium; platinum with iridium, rhenium, rhodium or mixtures thereof; but preferably, it is platinum. These are also referred below as reforming metals.

The amount of the reforming metal in the catalyst composition can range from 0.01 to 30 weight percent and preferably from 0.02 to 10 weight percent and most preferably from 0.05 to 5 weight percent.

The modifier (tin, indium or thallium) content of the crystalline materials can range from 0.01 to 20 weight percent. Practically, the modifier content will range from 0.1 to 10 weight percent.

The crystalline modifier containing materials of the invention include zeolites characterized by Si/Al ratios of at least 2. However, the silica:alumina ratio of the zeolite can be up to 1000, or greater. In specific embodiments the aluminum content of some of these materials is less than 0.1 weight percent.

The crystalline modifier containing material of the invention can contain other elements including boron, iron, chromium and gallium. The content of these other elements in the crystalline microporous materials can range from 0 to 10 weight percent.

The modifier containing precursors of the invention, described herein, are crystalline in the sense that they are identifiable as isostructural with zeolites by X-ray powder diffraction pattern.

The crystalline microporous modifier containing material has an X-ray diffraction pattern which corresponds to a zeolite, SAPO, ALPO, etc. For example, tin silicate compositions of the invention have been made the crystal structure of which is that of ZSM-5, ZSM-11, ZSM-12, ZSM-23, and ZSM-48, and the X-ray diffraction pattern and significant lines Tables of these materials have been described in the U.S. patent literature; these are characterized by pore sizes up to about 8 Angstroms. In a preferred embodiment the pore size of the microporous crystalline modifier containing silicates ranges from about 5 to about 8 Angstroms.

The term "microporous" as it refers to such material relates to pores, or channels, with diameters of less than 20 Angstroms. Examples of these microporous crystalline materials include crystalline silicates, crystalline alumino-silicates (zeolites), crystalline ALPOs, crystalline SAPO and related compositions and intercalated pillared materials derived from clays, layered silicates and titanates. The crystalline silicate, alumino silicate (zeolites), ALPOs and SAPOs, have pores of uniform size and channel systems which are uniquely determined by unit structure of the material. The uniform pore size and/or channel systems allow such a material to selectively absorb molecules of certain dimensions and shapes. In the art, microporous material having pores, or channels, of less than 20 Angstroms, can be divided into small, medium and large pore by the diameters of those pores, or channels. The pores of the small pore material have an average diameter of less than 5 Angstroms; medium size pores range from an average diameter of about 5 to about 7 Angstroms, and large pore silicates indicates a diameter of greater than about 7. The word "average" is used to refer to diameter to embrace those species in which the pore is elliptical. Alternatively, the demarcation between small, medium, and large pore materials can be based on the following sorption properties (measured at room temperature for crystallites having a minimum dimension of 0.1 micron):

1. Small pore: n-$C_6$/i-$C_6$ sorption ratio greater than approximately 10.
2. Medium pore: n-$C_6$/i-$C_6$ is less than 10 and n-$C_6$-/Mesitylene sorption ratio greater than approximately 5.
3. Large pore: n-$C_6$/Mesitylene sorption ratio less than approximately 5.

The compositions comprising hydrogenation/dehydrogenation metal combined with the non-acidic crystalline microporous modifier-containing materials do not exhibit any appreciable acid activity. These catalysts would meet the criteria of non-acidic catalysts described by Davis and Venuto, J. CATAL. Vol. 15, p. 363 (1969). Thus, a non-equilibrium mixture of xylenes are formed from either n-octane or each individual methylheptane isomer, with the n-octane yielding more o-xylene and 2-methyl-heptane yielding mostly m-xylene, at conversions between and 10 and 60%. Alternatively, the non-acidic compositions will exhibit a pH of at least 6 when added to distilled deionized pH7 water maintained under inert (such as argon) atmosphere; by an inert atmosphere in this context it means an atmosphere free of $CO_2$. Typically, in these tests, 100 mg of catalyst was added to 30 ml. of distilled deionized water. Some compositions will exhibit a pH of at least 7.5.

When, as in embodiments herein, the non-acidic crystalline microporous material containing reforming metal exhibits an X-ray diffraction pattern of a zeolite, at least some of the reforming metal may be intrazeolitic, that is, some of that metal is within the pore structure of the crystal, although some of that metal can be on the surface of the crystal. A test for determining whether, for example, Pt is intrazeolitic or extrazeolitic in the case of ZSM-5 is reported by R. M. Dessau, J. CATAL. Vol. 89, p. 520 (1984). The test is based on the selective hydrogenation of olefins.

These compositions used in catalysis decrease the hydrogen content of the reactant to produce a product having the same number of carbon atoms as the number of carbon atoms in the reactant. By comparison modifier-free counterparts of those compositions catalyzed also hydrogenolysis of paraffins, e.g., to methane, as a major competing side reaction; and, accordingly, the latter compositions exhibit decreased selectivity for the aromatization of paraffins but increased selectivity for $C_1$–$C_5$ paraffin production. Some of the aforementioned catalysts were screened for hexane and heptane aromatization at 538° C. in the presence of nitrogen diluent. The results are shown in Table A below in which the crystalline silicate employed exhibited the diffraction pattern of a ZSM-5.

TABLE A

| Paraffin Aromatization over Pt/ZSM-5 | | | | | |
|---|---|---|---|---|---|
| Support | Paraffin | Conversion | Benz. Sel.[c] | Tol. Sel. | C5-Sel |
| B/ZSM-5 | n-hexane | 52% | 31% | — | 12% [a] |
| " | " | 98% | 51% | 2% | 40% [a] |
| " | heptane | 56% | 56% | 8% | 7% [a] |
| " | " | 95% | 33% | 31% | 34% [a] |
| In/ZSM-5 | n-hexane | 60% | 81% | — | 1% |
| " | " | 99+% | 95% | — | 4% |
| " | heptane | 50% | — | 92% | 1% |
| " | " | 99% | — | 97% | 1% |
| Si/ZSM-5[b] | n-hexane | 58% | 69% | — | 18% [a] |
| " | " | 99% | 72% | — | 26% [a] |
| " | heptane | 34% | 45% | 17% | 14% [a] |
| " | " | 99% | 62% | 4% | 34% [a] |

[a] primarily methane.
[b] high silica/alumina ZSM-5.
[c] $H_2$-free selectivity based on carbon.

The non-acidic platinum catalyst prepared from In/ZSM-5 provided much higher aromatics selectivity than all the other catalysts examined. Benzene yields from hexane were as high as 95%, while heptane produced toluene in 97% yield ($H_2$free carbon base).

The other catalysts, including Pt/B-ZSM-5 and Pt/high silica:alumina ratio did not show any appreciable acid activity, in that platinum chemistry dominated. Significant metal-catalyzed aromatization was observed; however hydrogenolysis to methane constituted a major competing side reaction. The highest toluene selectivity observed was 50–55%, and in most cases that selectivity was significantly lower. This is in sharp contrast to the aromatic product selectivity of the platinum-/In/ZSM-5. By way of comparison and illustration, it is noted that over dual functional platinum on acidic alumina reforming catalysts, the rate of heptane cracking to $C_6^-$ was twice the rate of dehydrocyclization. Cf J. H. Sinfelt, "Bimetallic Catalysts", J. Wiley, New York; p. 141 (1983).

Synthesis of the Non-Acidic Crystalline Microporous Modifier Containing Compositions Specific examples of production of these materials are described in U.S. Pat. No. 4,868,145 (incorporated by reference herein), and in allowed application, U.S. Ser. No. 211,198, filed June 24, 1988 (incorporated by reference herein), and in U.S. Ser. No. 210,946, filed June 24, 1988.

The crystalline modifier-materials can be made in various ways. Modifier (tin, indium or thallium) incorporation can be during synthesis or post-synthesis; and the materials can be prepared either by stepwise or simultaneous incorporation of the modifier and the hydrogenation/dehydrogenation function. The dehydrogenation function can be first introduced to the synthesis product with subsequent modifier incorporation, or vice versa. Stepwise preparation includes techniques of cocrystallization, impregnation, or exchange. Crystallization can be undertaken in a two phase system described in commonly assigned U.S. Ser. No. 878,555, filed June 26, 1986. Other elements such as boron, iron chromium, gallium, can also be included. Simultaneous incorporation includes the combination of modifier with the dehydrogenation/hydrogenation function during synthesis (i.e., crystallization) or simultaneously after synthesis of the crystalline material.

A modifier free material can be treated with compounds containing the modifiers at elevated temperatures. Such treatments can be conducted so that the source of modifier is either in the gaseous (such as indium chloride) or the liquid phase including the aqueous phase (such as indium nitrate). Alternatively, an modifier free crystalline reactant can simply be impregnated with a modifier source and then calcined at temperatures above 400° C.

The modifier free material may have high silica:alumina ratios or contain other elements such as boron, chromium, iron, and gallium. Reactants and products containing 0.1 weight percent or less aluminum are preferred. In materials of the invention, all cation-exchangeable sites are occupied by non-hydrogen (non-proton) and by non-hydrogen precursors, such as $NH_4^+$. Specifically, such sites are occupied by $Na^+$, $K^+$, $Cs^+$ $Mg^{++}$, $Ca^{++}$, $Ba^{++}$, $Sr^{++}$, or admixtures thereof. The alkali metals serve to neutralize any acidity due to framework aluminum. The source of alkali metal cation can derive from cations incorporated during synthesis, in excess of the aluminum content thereof. Alternatively, one can treat the final product with a basic solution of an alkali metal hydroxide as a final step prior to use, as described for example in U.S. Pat. No. 4,652,360.

The non-acidic, crystalline, microporous, modified material and dehydrogenation reforming metal containing materials can be combined with a matrix or binder material to render them attrition resistant and more resistant to the severity of the conditions to which they will be exposed during use in hydrocarbon conversion applications. The combined compositions can contain 1 to 99 weight percent of the materials based on the combined weight of the matrix (binder) and material. This material will preferably be combined with non-acidic matrix or binder materials. A preferred matrix or binder material would be silica. The relative proportions of finely divided crystalline material and inorganic oxide gel matrix vary widely, with the crystal content ranging from about 1 to about 90 percent by weight and more usually, particularly when the composite is prepared in the form of beads, in the range of about 2 to about 80 weight percent of the composite.

Second Stage Conditions

The effluent from the first stage can be passed to the second stage of the process of the invention, without processing. In the second stage of the process of the invention, components of the first-stage effluent are reacted in the presence of an acidic catalyst comprising an acidic zeolite exhibiting a Constaint Index of 1 to 12, under conditions including a pressure ranging from about atmospheric to 500 psig, a temperature ranging from 400° to 1200° F., at liquid hourly space velocity ranging from 0.1 to 10 and a hydrogen cofeed to effluent ratio of 0 to 10:1.

Generally, the entire first stage effluent is passed to the second stage of the process of the invention. However, that effluent can be processed to remove fractions therefrom prior to second stage conversions. For example, a particular boiling range fraction may be removed from the first stage effluent prior to passing the other first stage products to the second stage. Fractions of the first stage effluent may be separated and recycled to the first stage. For example light e.g. $C_3$-$C_5$+ hydrocarbons or aromatics, may be recycled to the first stage as inert diluents.

Depending on the first stage feeds compositions, the exact conditions of the second stage conducted in the presence of an acidic catalyst can control the product distributions of the effluent from the second stage. At pressures of 50 to 500 psig temperatures of 400°-850° F., liquid hourly space velocities of 0.1 to 10 and hydrogen cofeed/hydrocarbon ratios of 0 to 10:1, the product of the second stage can be characterized as comprising a mixture of alkylated benzenes and $C_1$-$C_3$ hydrocarbons.

If conditions of a pressure ranging from about atmospheric to 100 psig, a temperature of from about 850° to 1200° F., a liquid hourly space velocity of 0.1 to 10 and a hydrogen cofeed:hydrocarbon ratio of 0 to 3:1, the product of the second stage will comprise olefins and paraffins and oligomeric products. Under the conditions of the process of the invention, normal paraffins are preferentially converted in the first stage to aromatics while pentanes methylpentanes, and cyclopentanes are converted to primarily olefins, with minimal isomerization.

This two stage process should greatly increase the overall yield of aromatic hydrocarbons obtained relative to either stage alone. The olefins, cycloparaffins, and isoparaffins remaining are converted over the second stage catalyst to increase total aromatics yields. Some isoparaffins may be only partially converted.

The Second Stage Catalyst

The catalyst of the second stage is acidic and comprises a zeolite selected from the group of zeolites exhibiting a Constraint Index of 1 to 12. The zeolite second stage catalyst composition may optionally include an gallium and/or zinc impregnated, deposited and/or ion-exchanged thereon. The catalyst may be a composite containing a matrix therein.

Preferably, the acidic catalyst comprises ZSM-5 in the acid form. The zeolite ZSM-5 as is reported in U.S. Pat. No. 3,702,886 together with its preparation and X-ray diffraction pattern. That patent is relied upon and incorporated by reference herein. ZSM-5 has been reported to exhibit a Constraint Index remaining within the range of 1 to 12, depending on the temperature of measurement.

The amount of dehydrogenation component or promoter, (e.g. gallium and/or zinc) which can be optionally included will range from 0 to 10 weight percent of the zeolite.

In practicing a particularly desired chemical conversion process, it may be useful to incorporate the above-described crystalline zeolite with a matrix comprising another material resistant to the temperature and other conditions employed in the process. Such matrix material is useful as a binder and imparts greater resistance to the catalyst for the severe temperature, pressure and reactant feed stream velocity conditions encountered in many cracking processes.

Useful matrix materials include both synthetic and naturally occurring substances, as well as inorganic materials such as clay, silica and/or metal oxides. The latter may be either naturally occurring or in the form of gelatinous precipitates or gels including mixtures of silica and metal oxides. Naturally occurring clays which can be composited with the zeolite include those of the montmorillonite and kalin families, which families include the sub-bentonites and the kaolins commonly known as Dixie, McNamee-Georgia and Florida clays or others in which the main mineral constituent is haloysite, kaolinite, dickite, nacrite or anauxite. Such clays can be used in the raw state as originally mined or initially subjected to calcination, acid treatment or chemical modification.

In addition to the foregoing materials, the zeolites employed herein may be composited with a porous matrix material, such as alumina, silica-alumina, silica-magnesia, silica-zirconia, silica-thoria, silica-beryllia, and silica-titania, as well as ternary compositions, such as silica-alumina-thoria, silica-alumina-zirconia, silica-alunina-magnesia and silica-magnesia-zirconia. The matrix, on an anhydrous basis, may vary widely with the zeolite content ranging from between 1 to about 99 percent by weight and more usually in the range of about 5 to about 80 percent by weight of the dry composite.

EXAMPLES

An experiment was conducted to illustrate the potential of this process concept. A pretreated light paraffinic naphtha, derived from Arabian Light crude, was passed over a non-acidic Pt/Sn ZSM-5 catalyst in the presence of a nitrogen diluent (5:1 $N_2$/HC mole ratio) at 20 psig. The entire effluent from this reaction was then passed over an acidic ZSM-5 catalyst operated under lower temperature conditions. On-line GC analyses of the interreactor and final product was used to predict compositions and octanes.

For comparison, the same acidic ZSM-5 catalyst was used for second stage processing of the light paraffinic naphtha feed.

| | LOW PRESSURE REFORMING FOLLOWED BY SECOND STAGE ONLY | | | SECOND |
|---|---|---|---|---|
| | Feed | Pt/[Sn]ZSM-5 | HZSM-5 | STAGE ONLY |
| Temperature °F. | — | 950.0 | 700.0 | 1000.0 |
| RON + 0 (GC) | 53.0 | 96.0 | 102.0 | 110.0 |
| MON + 0 (GC) | 53.0 | 84.0 | 91.0 | 99.0 |
| $C_{5+}$ Yield, wt % | 100.0 | 94.6 | 83.2 | 37.1 |
| $C_{5+}$ Yield, vol % | 100.0 | 83.7 | 70.5 | 29.4 |
| Hydrogen, wt % | 0.0 | 4.0 | 4.0 | 0.0 |
| C1 + C2 | 0.0 | 0.4 | 0.6 | 26.6 |
| C2 = to $C_5$ | 4.0 | 5.0 | 16.5 | 36.8 |
| $C_6$ + Paraffins, wt % | 81.3 | 21.8 | 14.3 | 0.2 |
| $C_6$ + Olefins | 0.0 | 11.0 | 0.0 | 0.0 |

-continued

| | LOW PRESSURE REFORMING FOLLOWED BY SECOND STAGE ONLY | | | SECOND |
|---|---|---|---|---|
| | Feed | Pt/[Sn]ZSM-5 | HZSM-5 | STAGE ONLY |
| $C_6$ + Naphthenes | 13.3 | 4.0 | 2.8 | 0.0 |
| $C_6$ + Aromatics | 5.4 | 53.7 | 61.8 | 36.4 |
| Benzenes, wt % | 1.9 | 25.7 | 22.3 | 9.6 |
| Toluene | 2.7 | 27.8 | 25.9 | 15.9 |
| C8+ Aromatics | 0.0 | 0.2 | 13.6 | 10.9 |

Feed: $C_6$/C7 Light Paraffinic Naphtha (pretreated Arab Light)
Reactor #1: 1.5% Pt/[Sn]ZSM-5
Reactor #2: HZSM-5 (70:1 Si/$Al_2$/) - used also for second stage results only
Conditions: 20 psig, 1.0 LHSV each catalyst, 5:1 Nitrogen/HC Second Stage only case at atmosphere, 0.5 LHSV, no diluent The data obtained after processing the light paraffinic naphtha over the non-acidic Pt/Sn ZSM-5 catalyst shows that benzene and toluene are formed with very little cracking to light gas. The olefins formed by dehydrogenation reactions are easily converted in the second reactor, along with additional paraffin cracking. The paraffins remaining are substantially methylpentanes. The final aromatics product is scrabled to higher alkylbenzenes with a net reduction of benzene. A substantial amount of high purity hydrogen is also produced.

When compared to results of the second stage of reforming the same light parffinic naphtha, the combined process of the present invention results in substantially higher yields of hydrogen and high octane gasoline while minimizing light gas make. Extinction conversion of the aromatizable hydrocarbons by results of the second stage with the HZSM-5 caalyst would result in a maximum gasoline (and also aromatics) yield approaching 53 vol. % on feed at about 110 R+O octane.

Related experiments using a non-acidic Pt/[In]ZSM-5 catalyst to aromatize and dehydrogenate the light paraffinic naphtha, followed by second stage treatment of the liquid product collected, reinforce the results obtained by on-line analyses in the preceding example. The results are shown below:

| Run # | Feed | Pt/[In]ZSM-5 | HZSM-5 |
|---|---|---|---|
| Temperature, °C. | — | 528.0 | 350.0 |
| WHSV | — | 1.4 | 1.3 |
| Pressure, psia | — | 14.7 | 14.7 |
| N2/HC | — | 2.5 | 2.5 |
| Liquid Yield, wt. % | 100.0 | 91.3 | 85.8 |
| Octane, R + O (GC) | about 51.0 | 93.2 | 95.1 (96.5) |
| Octane, M + O (GC) | about 51.0 | 80.2 | — (86.4) |
| Bromine # | 0 | 54.3 | 3.0 |
| Benzene, wt. % of TLP | 2.2 | 19.4 | 16.1 |
| Toluene | 2.8 | 14.2 | 18.1 |
| C8 Aromatics | — | 0.2 | 10.3 |
| C9+ Aromatics | — | — | 13.3 |

The results demonstrate that high yields of aromatic gasoline can be obtained by coupling the novel low pressure non-acidic dehydrocyclization process with aromatization and/or alkylation. GC analysis of the product indicates that the motor octane gain would be substantial as the olefin content is reduced (low bromine number) and the C8+ aromatics increase in the product.

Cofeeding light hydrocarbons, such as propane, with the light naphtha feed would be desirable in this process scheme. A fraction of the propane or other light hydrocarbon would be dehydrogenated in the first stage of the process and would then be readily converted to aromatic gasoline in the second stage. Cofeeding propane and butanes to the first reactor would result in increased gasoline yield and could be used to control gasoline vapor pressure.

By operating the combined process with higher reaction temperatures in the second stage, to effect essentially complete conversion of non-aromatics with boiling points similar to that of benzene, a high purity benzene product could be obtained by distillation. This would eliminate the need for aromatics extraction and subsequent disposal of the low quality raffinate currently practiced to obtain chemical grade benzene from traditional reformates.

In accordance with the invention, an integrated process utilizing a non-acidic dehydrogenation/dehydrocyclization catalyst followed by an acidic aromatization catalyst offers the potential for producing high purity benzene and high octane alkylaromatic gasoline. Potential yields are significantly greater than each stage of the integrated process.

What is claimed is:

1. A dual stage reforming process comprising:

contacting a feed containing a straight chain paraffin containing 6 to 12 carbon atoms with a non-acidic catalyst, under dehydrocyclization conditions, where said catalyst comprises two components one of which two components is a non-acidic medium pore zeolite containing a modifier selected from the group consisting of tin, indium and thallium and a second of which two components is a reforming dehydrogenation/hydrogenation metal and producing an effluent (1) which has an aromatic content greater than that of the feed and (2) which comprises olefins produced under said dehydrocyclization conditions;

contacting the effluent with an acidic catalyst comprising a zeolite having a constraint index of 1 to 12, under conditions of temperature ranging from 400° to 1200° F., a pressure ranging from about atmospheric to 500 psig, a liquid hourly space velocity 0.1 to 10 and a hydrogen cofeed to effluent ratio of 0 to 10:1, to convert said olefins to gasoline to produce a reformate which has an aromatic content greater than that of the effluent or has an RON greater than that of the effluent or has both.

2. The process of claim 1 further comprising cofeeding $C_3$–$C_5$ paraffins to said contacting in the presence of said non-acidic catalyst.

3. The process of claim 1, wherein said effluent is contacted with said acidic catalyst under conditions of temperature ranging from 400° to 850° F., a pressure from 50 to 500 psig, a liquid hourly space velocity of 0.1 to 10 and a hydrogen:effluent ratio of 0 to 10:1.

4. The process of claim 2, wherein said effluent is contacted with said acidic catalyst under conditions of temperature ranging from 400° to 850° F., a pressure from 50 to 500 psig, a liquid hourly space velocity of 0.1 to 10 and a hydrogen:effluent ratio of 0 to 10:1.

5. The process of claim 1, wherein said effluent is contacted with said acidic catalyst under conditions of temperature ranging from about 850° to 1200° F., a pressure of from about atmospheric to 100 psig, a liquid hourly space velocity of 0.1 to 10 and a hydrogen to effluent ratio of from 0 to 3:1.

6. The process of claim 2, wherein said effluent is contacted with said acidic catalyst under conditions of temperature ranging from about 850° to 1200° F., a pressure of from about atmospheric to 100 psig, a liquid hourly space velocity of 0.1 to 10 and a hydrogen to effluent ratio of from 0 to 3:1.

7. The process of claim 1, wherein said acidic catalyst includes gallium, zinc or both.

8. The process of claim 3, wherein said acidic catalyst includes gallium, zinc or both.

9. The process of claim 1, wherein said non-acidic zeolite is ZSM-5, ZSM-11, ZSM-12, ZSM-23, and, ZSM-48.

10. The process of claim 1, wherein said metal includes a platinum group metal.

11. The process of claim 1 wherein said metal is a Group VIII metal.

12. The process of claim 11, wherein said metal is platinum.

13. The process of claim 1, wherein said feed is a naphtha.

14. The process of claim 1, wherein said non-acidic zeolite is ZSM-5.

15. The process of claim 10, wherein said non-acidic zeolite is ZSM-5.

* * * * *